United States Patent [19]

Kuypers

[11] 4,215,559

[45] Aug. 5, 1980

[54] CORRUGATION APPARATUS

[75] Inventor: Hubert Kuypers, Bad Nenndorf, Fed. Rep. of Germany

[73] Assignee: Kabel-und Metallwerke Gutehoffnungshuette AG, Fed. Rep. of Germany

[21] Appl. No.: 9,516

[22] Filed: Feb. 5, 1979

[30] Foreign Application Priority Data

Feb. 6, 1978 [DE] Fed. Rep. of Germany ..... 2804990

[51] Int. Cl.[3] ..... B21D 15/06

[52] U.S. Cl. ..... 72/77; 72/121

[58] Field of Search ..... 72/77, 78, 79, 98, 114, 72/121

[56] References Cited

U.S. PATENT DOCUMENTS 3,648,502 3/1972 Klug et al. ..... 72/98

FOREIGN PATENT DOCUMENTS 7004425 10/1970 Netherlands ..... 72/77

*Primary Examiner*—Lowell A. Larson

*Attorney, Agent, or Firm*—James C. Jangarathis

[57] ABSTRACT

A corrugating ring for corrugating metal tubing having a helical corrugating rib which increases in height from the beginning thereof to a maximum height to increase corrugation depth, with the maximum height extending over at least 360°. The corrugating rib has a curved corrugating surface, and the radius of curvature of the surface increases from the beginning of the rib to the maximum height thereof whereby corrugation width is increased with corrugation depth.

5 Claims, 7 Drawing Figures

FIG. 5
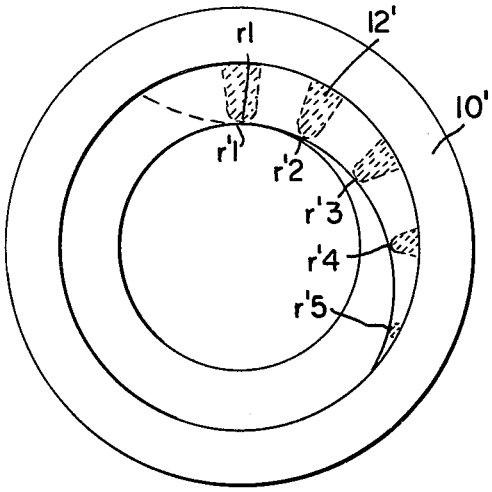
FIG. 6
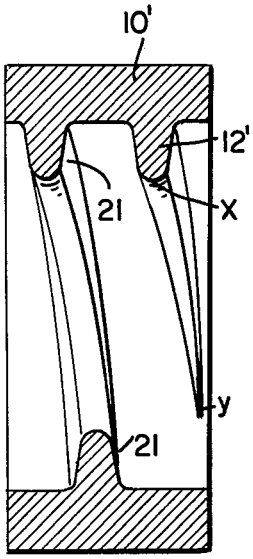
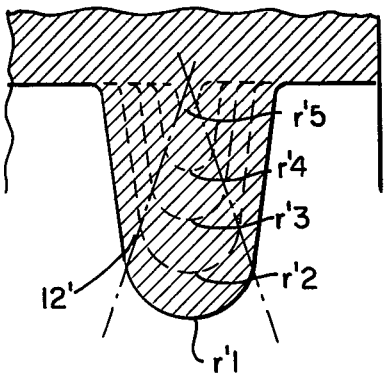
FIG. 7

CORRUGATION APPARATUS

This invention relates to corrugation of metal tubes, and in particular to the corrugation of thin-walled metal tubes.

Corrugated thin-walled metal tubes have been prepared from metal strips by continuously shaping the strip into a tubular configuration wherein opposite longitudinal edges of the strip are brought into abutting relationship and welded together. The welded tube is then corrugated by the use of annular corrugating discs to produce a helical corrugation having a defined depth of corrugation and pitch. In general, such corrugating disc is eccentrically disposed with respect to the axis of the tube and with a defined angle relative to the axis to provide the helical corrugation; e.g., German Pat. No. 1,086,314.

Attempts have also been made to provide annular corrugations by the use of a corrugating ring provided with a helical corrugating rib. In general, the corrugating apparatus includes a housing having a rotatably driven corrugating head supported coaxially with the tube to be corrugated. The corrugating head includes an inclined corrugating ring freely rotatable eccentrically with respect to the tube to be corrugated, with the corrugating ring including on its surface facing the tube a helical corrugating rib to thereby provide annular corrugations. In order to provide such corrugations, the corrugating ring in the corrugating head was arranged with an inclination below the angle of the thread. In addition, it was necessary to establish a defined relation between the axis of rotation by which the corrugating ring is inclined and the corrugation, as well as between the adjustment of the eccentricity and the corrugation; e.g., German Pat. No. 1,916,357 (U.S. Pat. No. 3,656,331).

In producing such corrugations, however, undesirable deformations or distortions occurred, especially when the tube was formed of a material which was not readily deformable, with such distortions being evidenced in the form of a spiral on the tube in the direction of the longitudinal axis of the tube.

In accordance with the present invention there is provided an improvement in the apparatus for producing annular corrugation of metal tubing. In accordance with the present invention, there is provided an improvement in the corrugating ring for corrugating metal tubing which has a helical corrugating rib for producing annular corrugations by increasing the height of the helical corrugating rib from the beginning thereof to increase the corrugation depth, with the increased height being maintained over at least 360°. The helical corrugating rib has a curved corrugating surface, with the radius of curvature of the corrugating surface increasing from the beginning of the corrugating rib to the increased height whereby the corrugation width is increased with the corrugation depth. Applicant has found that such a construction produces annular corrugations without undesirable distortions.

In accordance with a further embodiment, the sides or flanks of the corrugating rib extend angularly with respect to the axis of symmetry of the rib. Such an expedient has been found to stabalize the corrugating rib.

In accordance with another embodiment, the radius of curvature of the ring extends at the beginning of the corrugating rib over a distance equal to half the inside diameter of the corrugating ring plus the height of the corrugating rib and around the center point of the corrugating ring displaced by the height of the corrugating rib. This measure is useful for achieving optimum corrugation.

The invention will be further described with respect to embodiments thereof illustrated in the accompanying drawings; wherein:

FIG. 5 is a front view of another embodiment of a corrugating ring in accordance with the present invention;

FIG. 6 is a cross-sectional view of the embodiment of FIG. 5; and

FIG. 7 is a detailed cross-sectional view of a portion of the corrugating ring of FIG. 5.

Figure 1:
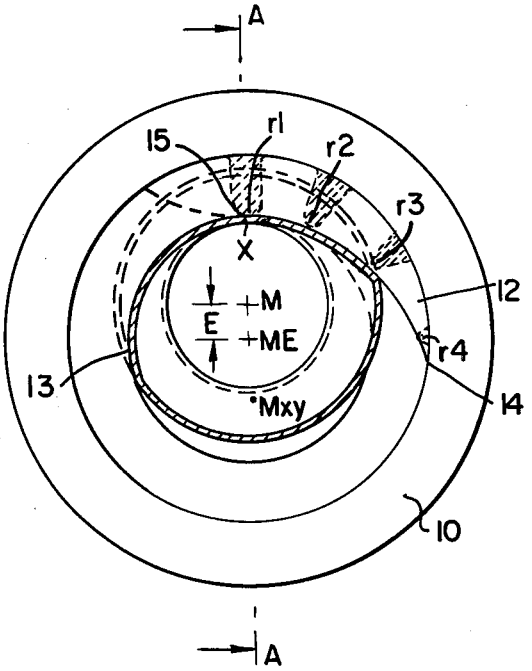
FIG. 1 is a front view of an embodiment of a corrugating ring in accordance with the present invention.
Figure 2:
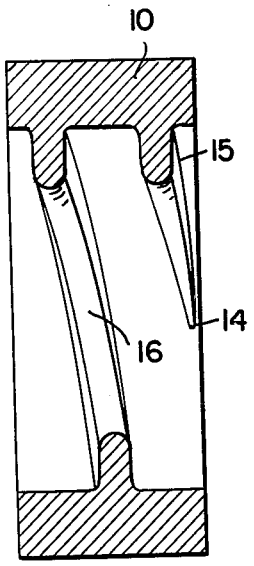
FIGS. 2 and 3 are cross-sectional views of the embodiment of FIG. 1.
Figure 3:
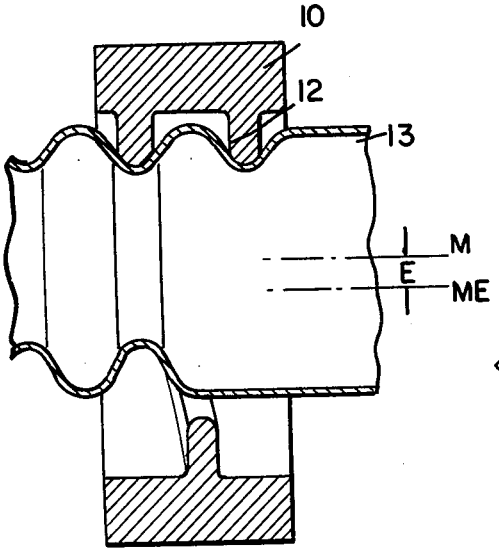

Referring now to FIGS. 1–4 of the drawings, there is shown a corrugating ring 10, which includes a helically shaped corrugating rib 12 for effecting corrugation of a metal tube 13 in a corrugating assembly in accordance with the general principles of U.S. Pat. No. 3,656,331, which is hereby incorporated by reference.

In accordance with the present invention, the helically shaped corrugating rib 12 increases in height from the beginning 14 thereof to a point 15 at which the rib 12 is at a maximum height. In accordance with the present invention, such maximum height of the corrugating rib 12 extends over at least 360°.

Figure 4:
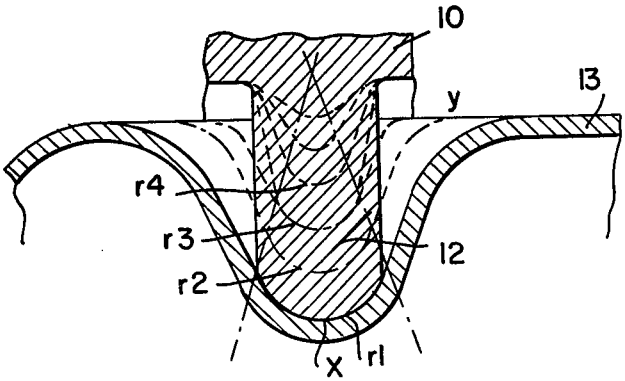
FIG. 4 is a detailed sectional view of a portion of the embodiment of FIG. 1.

In accordance with the present invention, the corrugating rib 12 has a curved corrugating surface 16, with the radius of curvature of the corrugating surface 16 increasing from the beginning of the corrugating rib to the point at which the corrugating rib has a maximum height. Thus, as schematically shown in FIGS. 1 and 4, the radius of curvature and cross-section of the rib, at the corrugating surface increases from the beginning point Y to the point of maximum height X, with such increase being designated as $r_4$ to $r_1$, with the radius of curvature increasing from $r_4$ to $r_1$.

The inlet portion of corrugating rib 12 has a larger radius of curvature than the remaining portion of corrugating rib 12 in that the radius of curvature is increased by the height of the deforming rib. The arc of the ring at the beginning portion 12 is extended around point Mxy which, in the direction of axis A—A is displaced from center point ME of the ring by the height of the rib, wherein M is the center point of the tube 13.

In accordance with another embodiment of the invention, as illustrated in FIGS. 5–7, wherein like parts are designated by like prime numerals, the corrugating ring and ribs are constructed in a manner essentially identical to the embodiment of FIGS. 1–4, except that the sides or flanks 21 of the corrugating rib are not parallel to each other; i.e., the sides or flanks extend angularly with respect to the axis of symmetry of the corrugating rib, and the base of the rib increases in width from the beginning of the rib to the point of maximum height.

The present invention is particularly advantageous in that annular corrugations can be produced without undesirable distortions. Such undesirable distortions are believed to have been eliminated by providing for a more gradual immersion of the inlet of the corrugating rib into the tube.

Numerous modifications and variations of the present invention are possible in light of the above teachings and, therefore, within the scope of the appended claims, the invention may be practiced otherwise than as particularly described.

I claim:

1. In a corrugating ring of a corrugating apparatus for continuously corrugating a thin-walled metal tube to form annular corrugations in the outer and opposite interior surfaces of said thin-walled metal tube, said apparatus including a housing having a rotatably driven corrugating head supported coaxially with the metal tube to be corrugated, said corrugating ring freely rotatable eccentrically with respect to said metal tube, said corrugating ring including on its surface facing said metal tube a unitary helical corrugating rib, the improvement comprising:

said helical corrugating rib increasing in height from the beginning thereof to a point of increased height to increase corrugation depth, said increased height extending over at least 360°, said helical corrugating rib having a curved corrugating surface, the radius of curvature of the corrugating surface increasing from the beginning of the helical corrugating rib to the point of increased height of the helical corrugating rib whereby corrugation width is increased with corrugation depth.

2. The corrugating ring of claim 1 wherein the radius of curvature of the helical corrugating rib from the beginning thereof to the point of increased height is equal to half the inside diameter of the ring plus the increased height.

3. The corrugating ring of claim 2 wherein the radius of curvature of the helical corrugating rib from the beginning thereof to the point of increased height extends around the center point of the ring displaced by the increased height.

4. The corrugating ring of claim 1 wherein the sides of the rib are angularly displaced with respect to the axis of symmetry of the rib.

5. The corrugating ring of claim 4 wherein the base of the rib increases in width from the beginning thereof to the point of increased height.

* * * * *